US006865828B1

(12) United States Patent
Molino et al.

(10) Patent No.: US 6,865,828 B1
(45) Date of Patent: Mar. 15, 2005

(54) ASSEMBLIES OF TEETH OF EARTH MOVING MACHINES

(75) Inventors: Javier Puevo Molino, Barcelona (ES); Jorge Pallas Moreno, El Masnou (ES); Nil Vallve I Bertran, Cabrils (ES); Rafael Ferrer Ruiz, Barcelona (ES)

(73) Assignee: Metalogenia, S.A., Barcelona (ES)

( * ) Notice: Subject to any disclaimer, the term of this patent is extended or adjusted under 35 U.S.C. 154(b) by 0 days.

(21) Appl. No.: 10/089,596

(22) PCT Filed: Sep. 28, 2000

(86) PCT No.: PCT/ES00/00364

§ 371 (c)(1),
(2), (4) Date: Aug. 16, 2002

(87) PCT Pub. No.: WO01/25550

PCT Pub. Date: Apr. 12, 2001

(30) Foreign Application Priority Data

Oct. 1, 1999 (ES) ..... 9902161

(51) Int. Cl.[7] ..... E02F 9/28
(52) U.S. Cl. ..... 37/454; 37/455
(58) Field of Search ..... 37/446–458; 172/713, 172/719, 721, 749, 772.5

(56) References Cited

U.S. PATENT DOCUMENTS

| | | | | |
|---|---|---|---|---|
| 247,148 A | * | 9/1881 | Anderson | 172/704 |
| 1,775,984 A | | 9/1930 | Younie | |
| 2,050,014 A | | 8/1936 | Morrison | |
| 2,435,846 A | | 2/1948 | Robertson | |
| 2,921,391 A | | 1/1960 | Opsahl | |
| 3,117,386 A | | 1/1964 | Ferwerda | |
| 3,496,658 A | | 2/1970 | Eyolfson | |
| 3,520,224 A | | 7/1970 | Hensley et al. | |
| 3,574,962 A | | 4/1971 | Smith | |
| 3,839,805 A | | 10/1974 | Stepe | |
| 3,919,792 A | | 11/1975 | Hahn et al. | |
| 4,182,058 A | | 1/1980 | Poncin | |
| 4,192,089 A | | 3/1980 | Schwappach | |
| 4,414,764 A | | 11/1983 | Johansson et al. | |
| 4,625,439 A | | 12/1986 | Johansson et al. | |
| 4,727,663 A | | 3/1988 | Hahn | |
| 4,799,823 A | | 1/1989 | Williams | |
| 4,811,505 A | | 3/1989 | Emrich | |
| 4,965,945 A | * | 10/1990 | Emrich | 37/456 |
| 5,068,986 A | | 12/1991 | Jones | |
| 5,088,214 A | | 2/1992 | Jones | |
| 5,325,615 A | | 7/1994 | Hutchins et al. | |
| 5,386,653 A | | 2/1995 | Cornelius | 37/454 |
| 5,456,029 A | | 10/1995 | Cornelius | |
| 5,469,648 A | | 11/1995 | Jones et al. | |
| 5,502,905 A | | 4/1996 | Cornelius et al. | |
| 5,561,925 A | * | 10/1996 | Livesay | 37/455 |
| 5,617,655 A | | 4/1997 | Launder et al. | |
| 5,653,048 A | | 8/1997 | Jones et al. | |
| 5,765,301 A | | 6/1998 | Clendenning | |

(List continued on next page.)

FOREIGN PATENT DOCUMENTS

| | | |
|---|---|---|
| ES | 0 419 646 A1 | 3/1976 |
| ES | 2077412 | 11/1995 |
| ES | 2146174 | 7/2000 |
| GB | 1272955 | 5/1972 |

*Primary Examiner*—Meredith Petravick
(74) *Attorney, Agent, or Firm*—Sughrue Mion, PLLC

(57) ABSTRACT

The improvements provide for the lugs of the tooth to have stepped guides at the top and bottom which combine with widened end regions for greater reinforcement and with a projecting internal abutment in at least one of said lugs, capable of being guided in a corresponding straight guide of the tooth holder, being arranged, after it is mounted, so as to retain the pin from behind, which pin is arranged in a pin seating arranged generally vertically in the body of the tooth holder, with a gently curved and inclined structure.

40 Claims, 17 Drawing Sheets

U.S. PATENT DOCUMENTS

| | | | | | |
|---|---|---|---|---|---|
| 5,778,570 | A | | 7/1998 | Eichelberger | |
| 5,802,752 | A | | 9/1998 | Quarfordt | |
| 5,918,391 | A | | 7/1999 | Vinas Peya | |
| 5,987,787 | A | | 11/1999 | Mack | |
| 6,030,143 | A | | 2/2000 | Kreitzberg | |
| 6,047,487 | A | | 4/2000 | Clendenning | |
| 6,240,663 | B1 | | 6/2001 | Robinson | |
| 6,321,471 | B2 | | 11/2001 | Fernandez Munoz et al. | |
| 6,477,796 | B1 | * | 11/2002 | Cornelius | 37/452 |
| 2001/0001352 | A1 | * | 5/2001 | Munoz et al. | 37/455 |

* cited by examiner

ASSEMBLIES OF TEETH OF EARTH MOVING MACHINES

CROSS-REFERENCE TO RELATED APPLICATIONS

This application is a U.S. national phase application under 35 U.S.C. §371 based upon co-pending International Application No. PCT/ES00/00364 filed Sep. 28, 2000, the entire disclosure of which is incorporated herein by reference. The international application was published in the English language on Apr. 12, 2001 under Publication No. WO 01/25550.

The present invention relates to improvements introduced into couplings for machines intended for earth-moving, providing appreciable characteristics of novelty and inventive activity with respect to the couplings known in the art for the aforesaid purpose.

In particular, the couplings of the present invention wilt be applicable to loading and excavating machines in their various versions and types, although, more widely, they will be applicable to all earth-moving machines which have a working bucket provided with a rim having exchangeable teeth intended to cut into the earth which is to be worked.

The present invention is intended to provide appreciable functional improvements in the coupling part of the tooth and the tooth holder, providing greater strength and reinforcing the coupling region of the lugs of the tooth, eliminating possible concentrations of stresses. It is also possible to increase the surfaces resisting vertical stresses, and in general a greater penetration is achieved.

Similarly, the seating of the pin is arranged in the body of the tool holder and not in the nose of the tooth, as is customary, its arrangement being generally vertical and on one side of said body of the tool holder, being able to be straight or having a slight curvature. In a front view, the seating will customarily be inclined outwards, since it follows the course of the lateral surfaces of said body. Moreover, the seating has chamfers on the inlet edges in order to improve the mounting of the pin, especially in the course of work in the field.

For greater understanding thereof, explanatory drawings of a preferred embodiment of the present invention are appended by way of non-limiting example.

Figure 24:
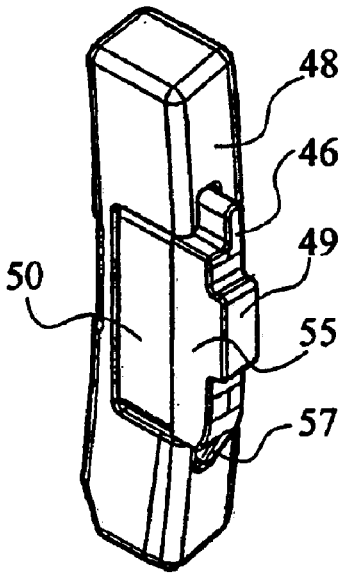
Figure 25:
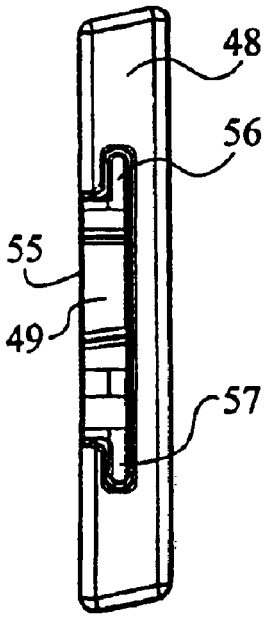
Figure 26:
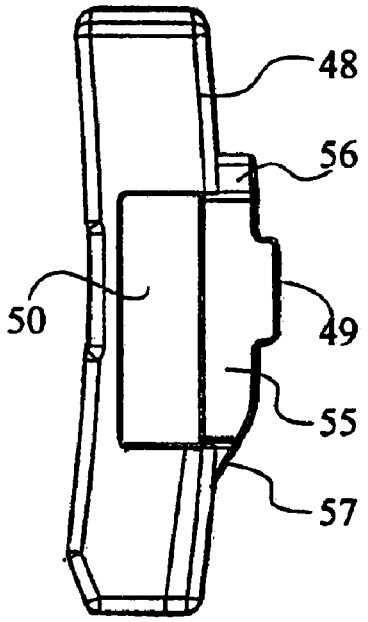

FIGS. 24, 25 and 26 respectively show a perspective view, a view in front elevation and a view in side elevation of the pin.

Figure 27:
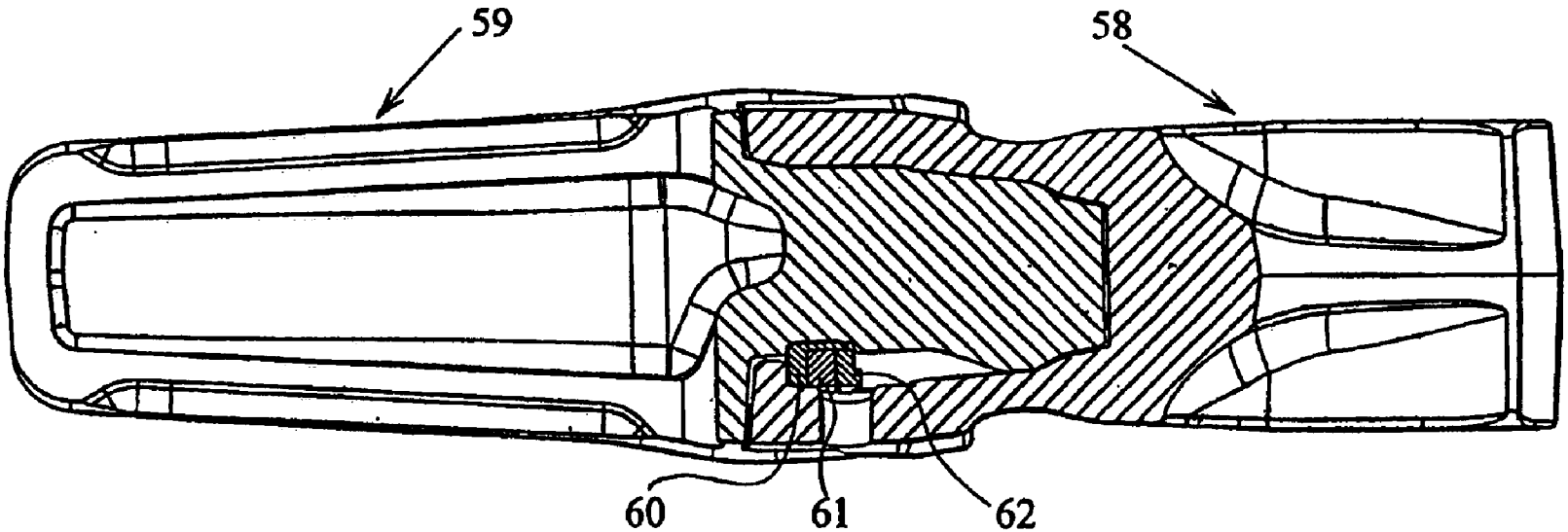

FIG. 27 shows a longitudinal section through the assembly of tooth and tooth holder, showing the pin in section.

As can be observed in the figures the assembly of tooth and tooth holder, once mounted, has the structure shown in FIGS. 1 to 5, in which can be seen the tooth holder 1 and the tooth 2, coupled to each other, and the lateral lugs 3 and 4 which are introduced into respective seatings of the tooth holder 1, the constitution of which will be explained in detail, and likewise there will be observed the upper opening 5 for the fixing pin for the tooth and tooth holder.

The seating of the pin, the genera) orientation of which is vertical, has, in detail, a structure in which there stands out a slight curvature and a slightly inclined arrangement, as will be observed in a front view, with a trajectory substantially parallel to the lateral outer surface of the nose of the tooth holder.

Figure 11:
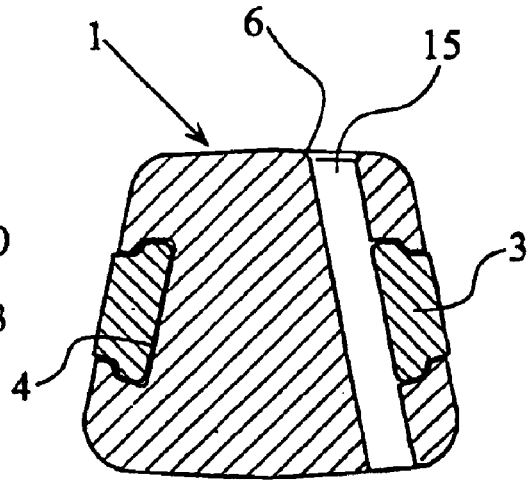
Figure 12:
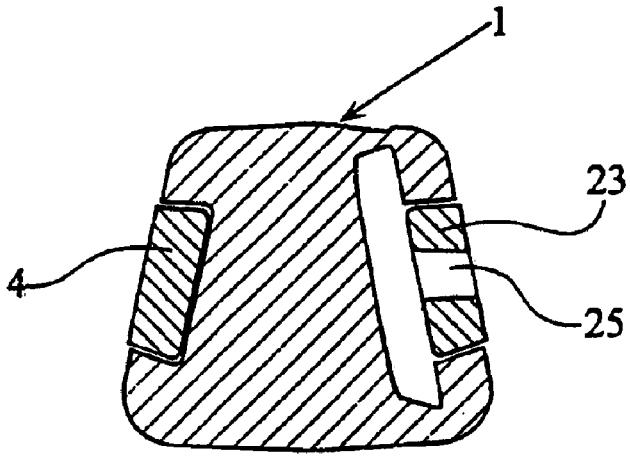
Figure 13:
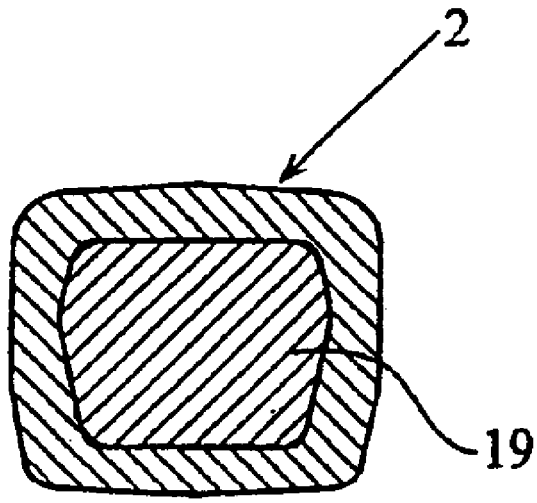
Figure 14:
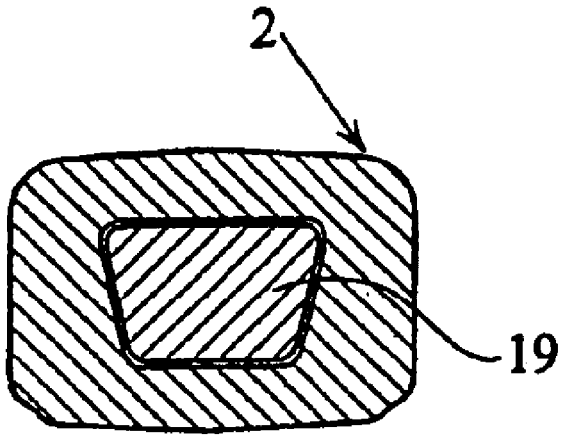
Figure 15:
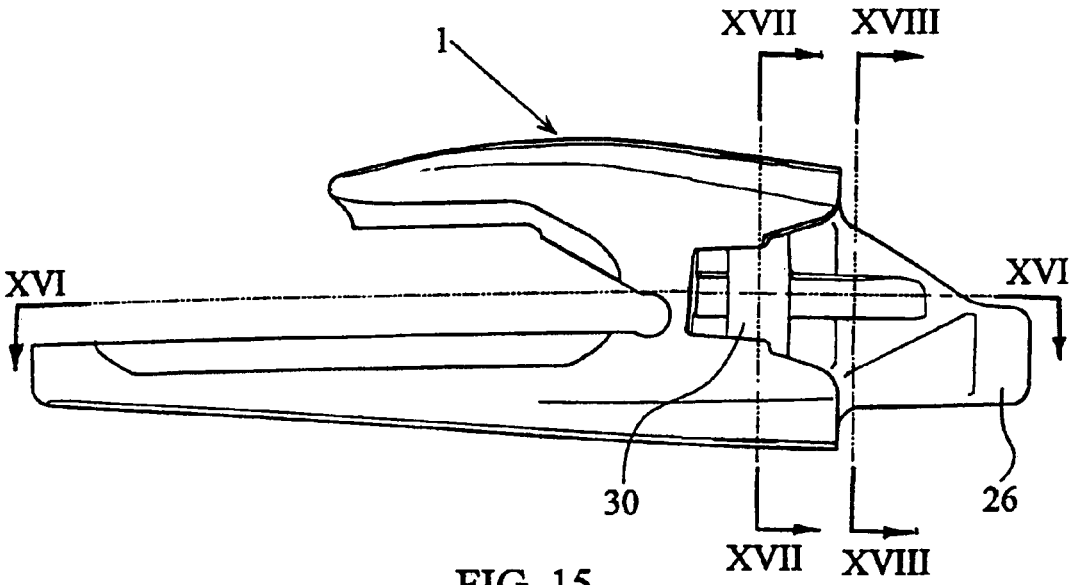
FIG. 15 is a view of the tooth holder in side elevation.
Figure 16:
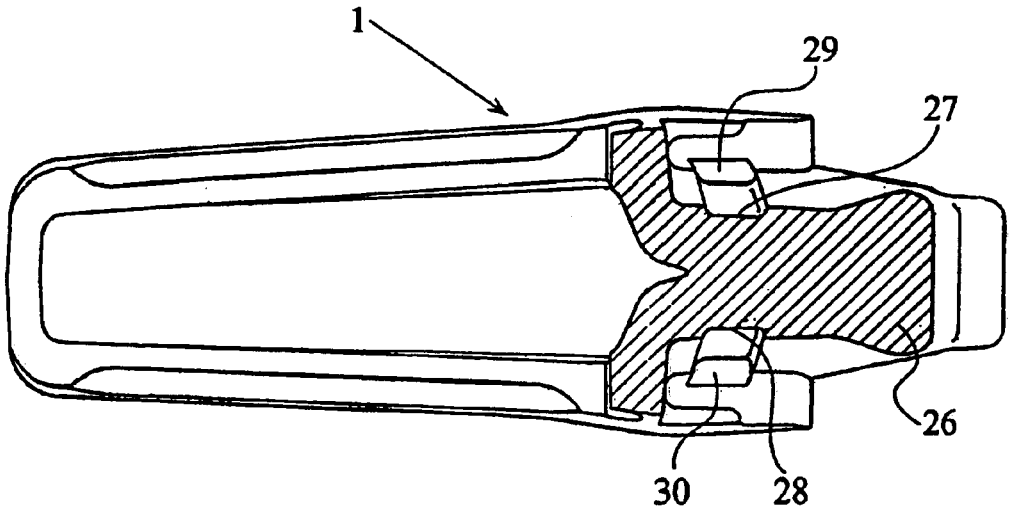
FIG. 16 shows a section through a horizontal plane of the tooth holder indicated in FIG. 15.

The aforesaid arrangement will be noted especially in FIG. 11, in which there is also to be observed the arrangement of an upper chamfer 6, intended to improve the introduction of the pin.

The arrangement of the seating 5 of the pin in the body 1 of the tooth holder and not in the nose makes it possible to obtain greater robustness of the latter and removes the pin from the area of attack of the assembly, protecting it in great measure against wear. The generally vertical arrangement of the seating of the pin facilitates its mounting and disassembly, while its possible inclination and curvature allow the pin to be retained in the guide, being trapped from behind by the abutment provided at the end of one of the lugs, as will be explained hereinafter. Similarly, the curvature of the seating removes the hole from the front end wall, avoiding the creation of weak areas subject to breakage.

The constitution of the seating of the pin and the securing of the tooth make it possible to design the pin with a length shorter than that of the seating, so that the ends are not flush with the body of the tooth holder, which reduces the wear on the pin and reduces impacts, avoiding not only deterioration but also the possibility of loss of the pin, as occurs in some cases at present.

As will be understood, although the constitution of the pin and its seating will comply with the preferred version which has been described, the seating could have no curvature, being completely straight, or have a curvature in the opposite direction to that shown. Similarly, the inclination of the seating in a lateral direction could be reduced or eliminated.

Moreover, the seating may be arranged on one side or the other of the tooth holder or simultaneously on both sides for applications where the work is very hard. A second pin could also be incorporated in order to ensure the securing of the tooth in the tooth holder and increase the stability and robustness.

Figure 1:
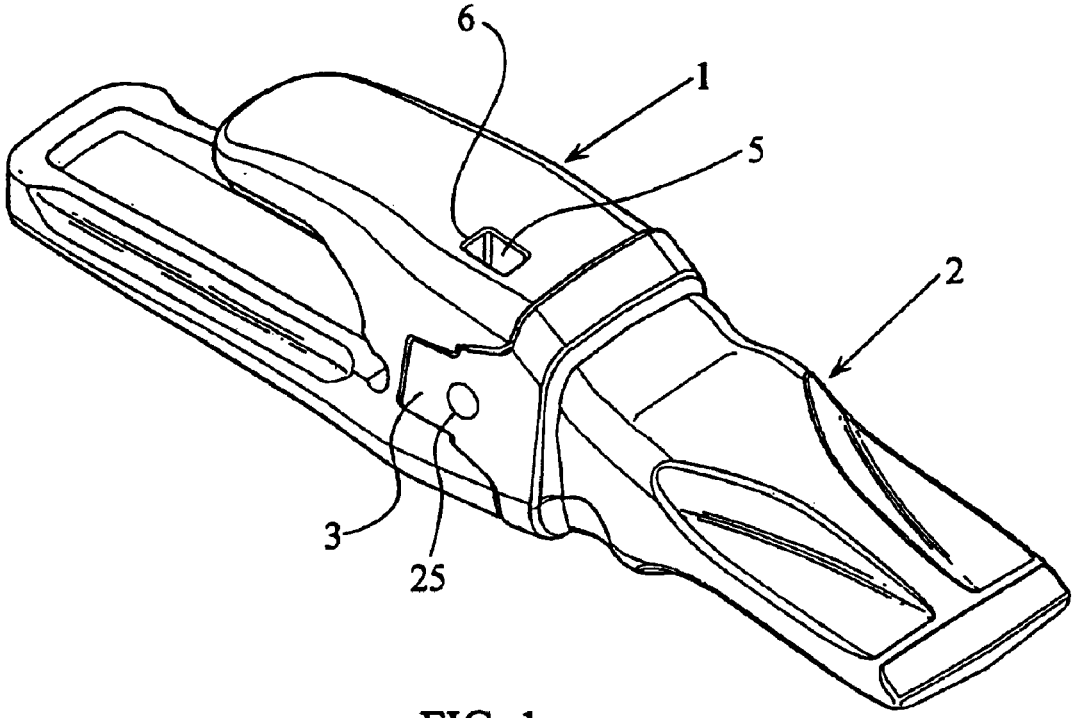
FIG. 1 is a perspective view of an assembly of tooth and tooth holder which incorporates the present invention.
Figure 2:
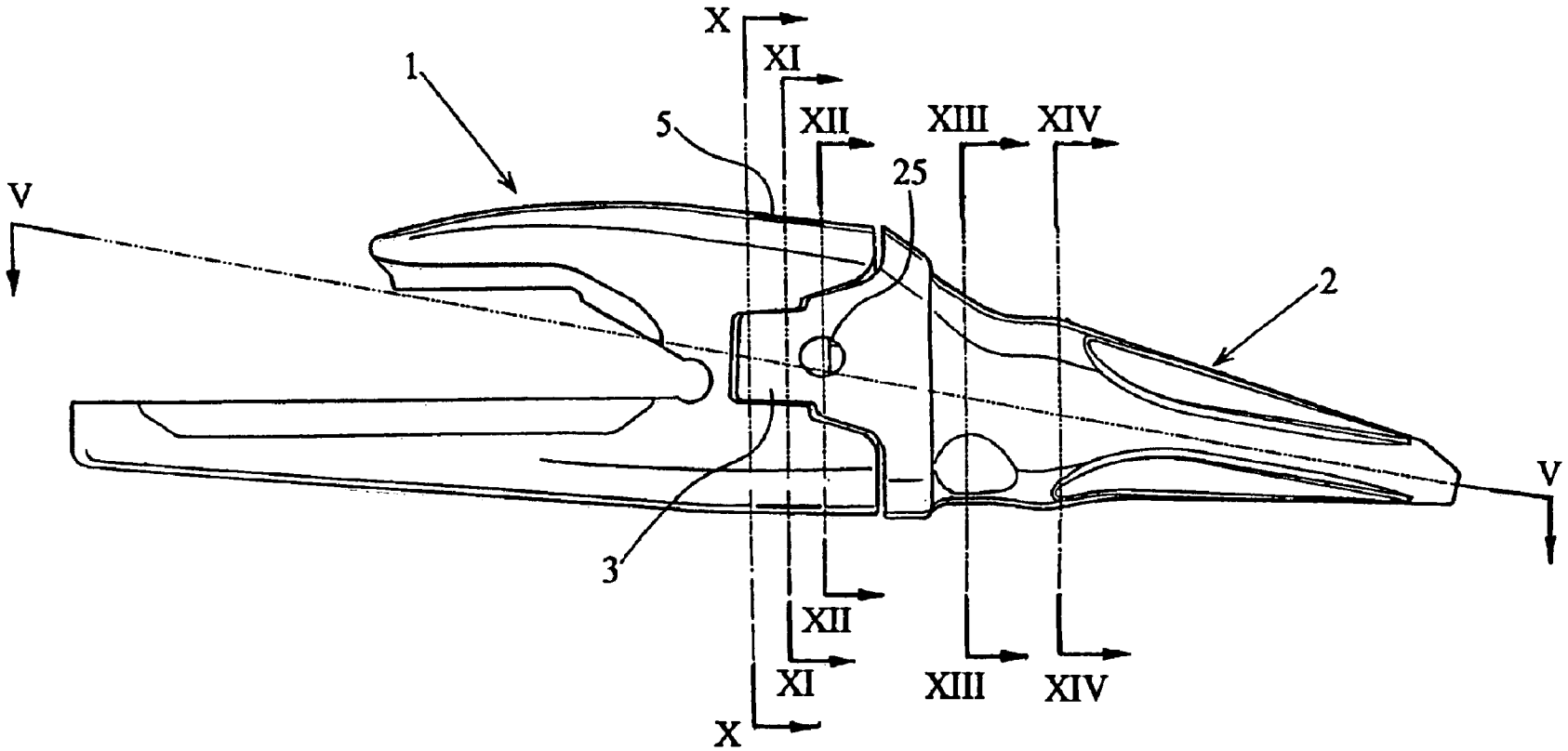
FIG. 2 is a view in side elevation of the same assembly as in FIG.
Figure 3:
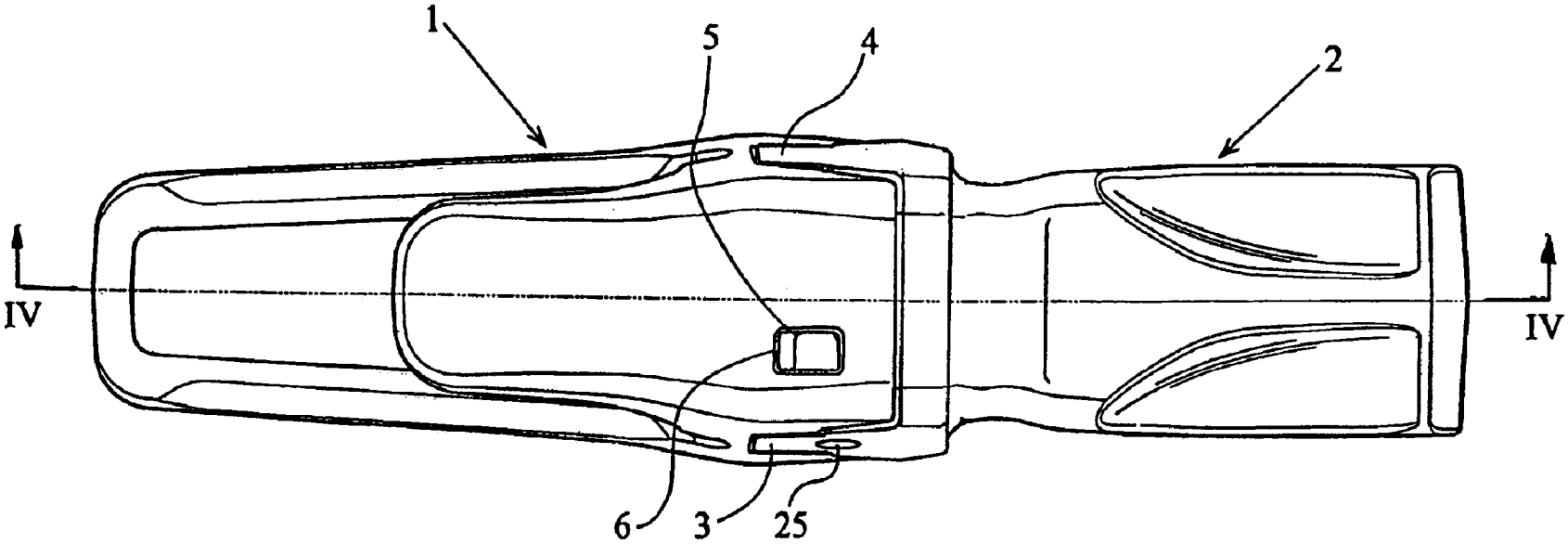
FIG. 3 is a plan view of the same assembly as in FIG. 1.
Figure 4:
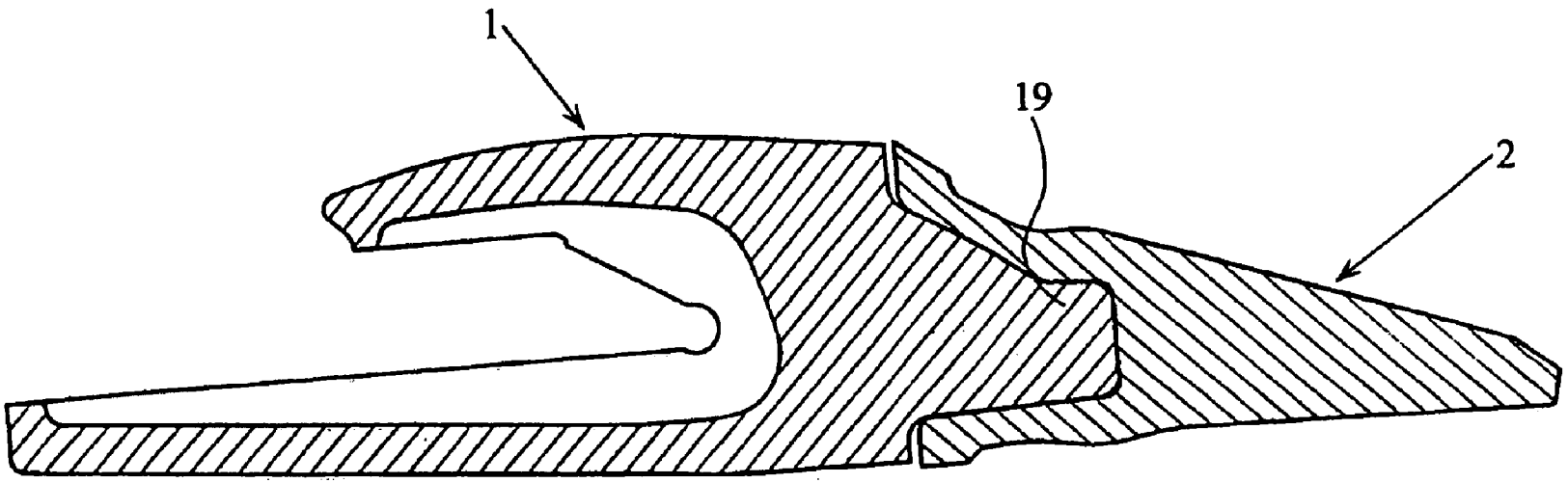
FIG. 4 shows a longitudinal section through the plane indicated.
Figure 5:
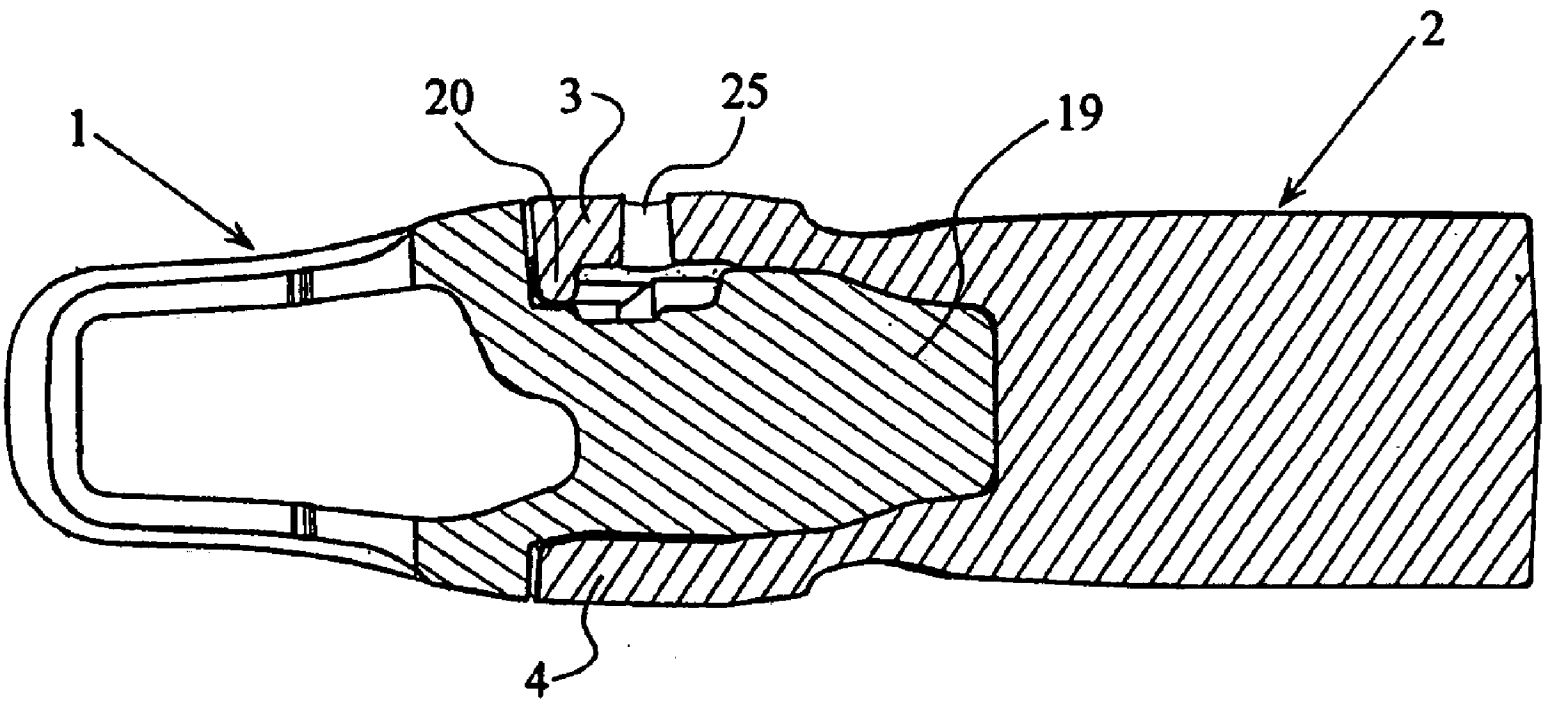
FIG. 5 shows a section through a horizontal plane, as indicated in FIG. 2.
Figure 6:
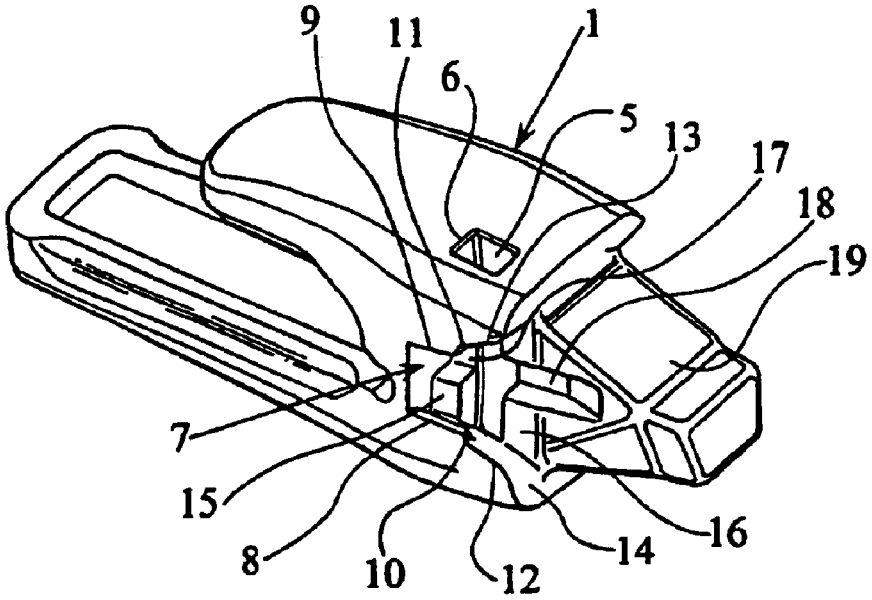
FIG. 6 is a perspective view of the tooth holder of the present invention.
Figure 7:
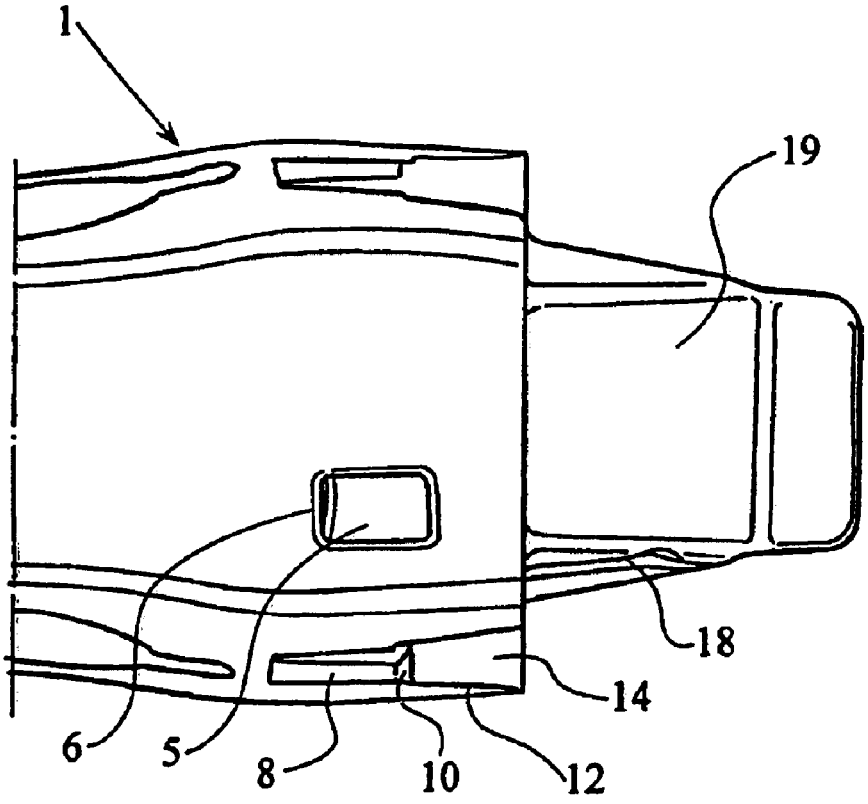
FIG. 7 is a plan view of the coupling end of the tooth holder.
Figure 8:
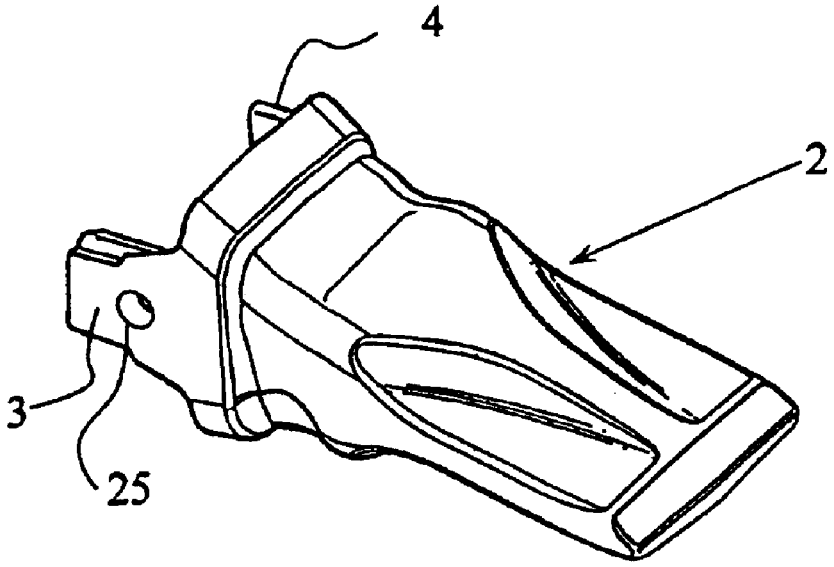
FIG. 8 is a front perspective view of the tooth.
Figure 22:
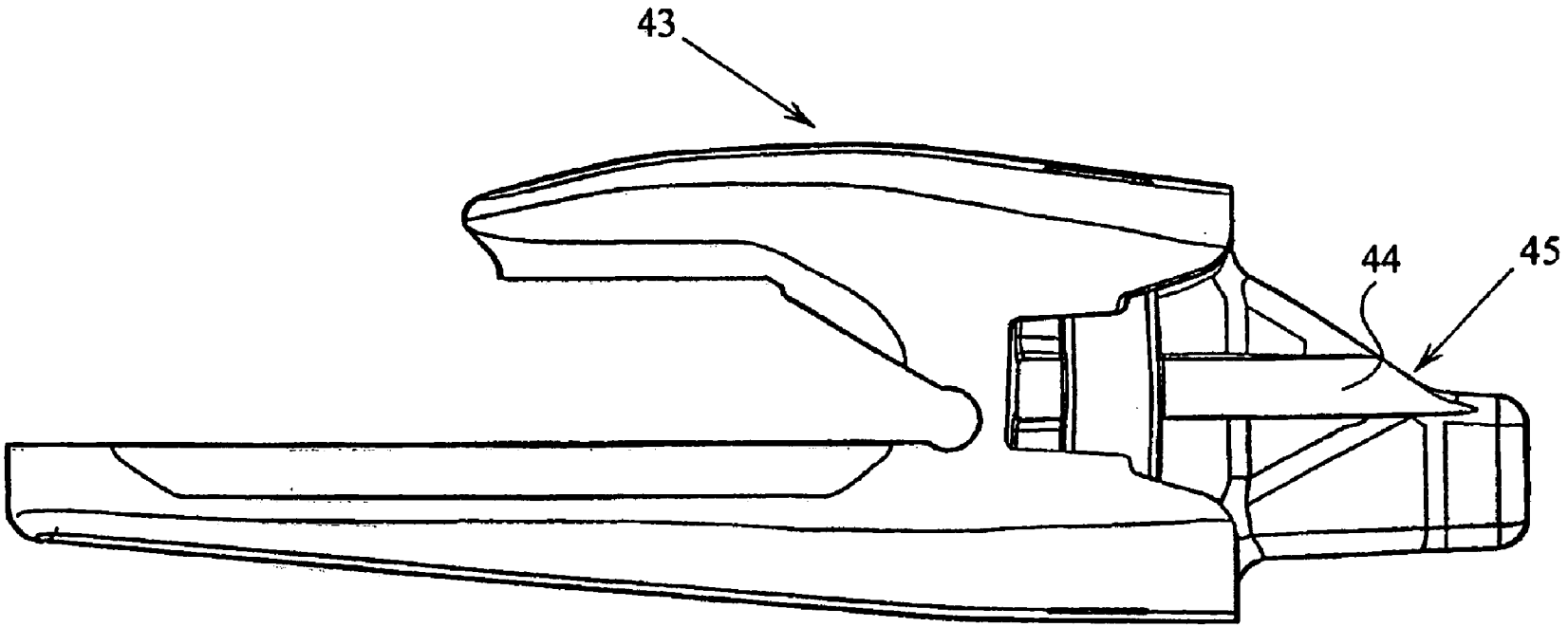
FIG. 22 is a view in side elevation of a tooth holder according to the present invention, showing the seatings or guides for the tooth in a through arrangement, that is to say, opening into the end of the nose of the tooth holder.

The lugs 3 and 4 of the tooth are housed in lateral cavities of the tooth holder which are preferably slightly inclined, one of them being indicated by the number 7 in FIG. 6. The lugs 3 and 4 preferably have an inclination which corresponds to the course of the lateral walls of the tooth holder, that is to say, as can be observed in the figures, a transverse inclination according to which the upper edges are arranged further towards the interior than the lower edges. That is to say, an inclination which corresponds to a certain rotation of the lugs on their longitudinal axes so that the upper edges and the lower edges of the lugs are in different vertical planes. If desired, said angle of inclination may be zero. Said cavities have a stepped section, combining different types of flat, curved and other surfaces. It determines the lateral partition walls 8 and 9 which in turn have respective steps 10 and 11 for joining to widened abutment regions 12 and 13 which preferably have a curvature such as that indicated by the number 14, corresponding to the lower part, but which could also form a wide inclined plane or a straight step or other suitable shape to widen the bearing area. Into the cavity 7, which corresponds to the seating 5 for the pin, the wall of the seating for the pin, as can be observed in FIG. 6. Similarly, in the front part 15 and in the rear part 16 of the cavity 7 there are respective aligned seatings 17 and 18 which constitute a straight guide intended to permit the passage of the end abutment 20 of the lug of the tooth, for retention of the pin which passes through the tooth holder. The length of the groove formed by the passages 17 and 18 may be less than the total length of the nose or projection 19 intended to fit together with the tooth holder, in order in this way to obtain a greater useful section and, therefore, greater strength. Nevertheless, as shown in FIG. 22, the tooth holder 43 may have a seating 44 to receive the tooth of the tooth holder which is of the through type, that is to say, which opens into the end of the nose or rear projection 45.

Figure 10:
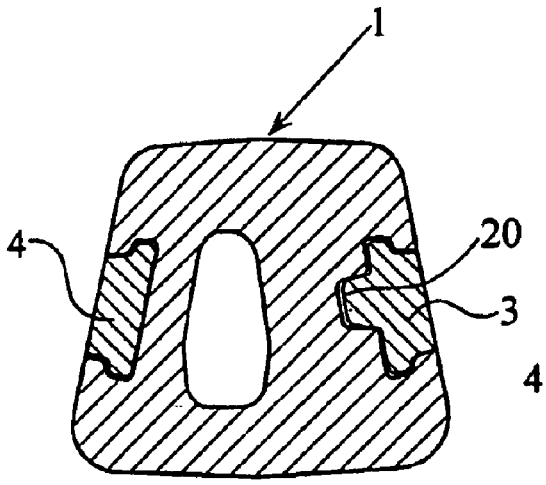
FIGS. 10 to 14 show cross sections of the assembly of tooth and tooth holder according to the section planes indicated in FIG. 2.

The lateral abutment projection for guiding the tooth in the tooth holder, provided on one of the lateral lugs, for example the lug 3, has been shown in FIG. 10, in which can be observed said abutment 20, which is introduced into the guide provided in the lateral seating cavity of the tooth holder.

The precise shape of the nose 19 may be varied without this affecting the constitution of the actual coupling part between the tooth and the tooth holder, which basically affects the lugs 3 and 4, as well as their corresponding seatings and the seating for the pin in a special arrangement in the body of the tooth holder.

Into the present invention different variations may be introduced which will remain within the scope thereof as indicated in the claims. Thus, for example, the seatings of the lugs, which have a certain inclination in the example shown, could have no inclination or could be perpendicular to the base or arched.

Similarly, the internal stepped shape of the lugs and of the matching cavities of the tooth holders could be a combination of two different surfaces, for example, flat/flat or flat/curved, curved/curved or of some other type. Provision could also be made for the cavities not to have a stepped shape, with a single surface which may be flat or rounded. Alternatively, the cavities may have a right-angled shape and the guide for the tooth in the tooth holder could be arranged on one side or the other or on both simultaneously.

It will also be understood that the guide for the tooth in the tooth holder, the length of which is preferably limited to only a part of the length of the nose of the tooth holder, could also extend for the entirety thereof.

Figure 9:
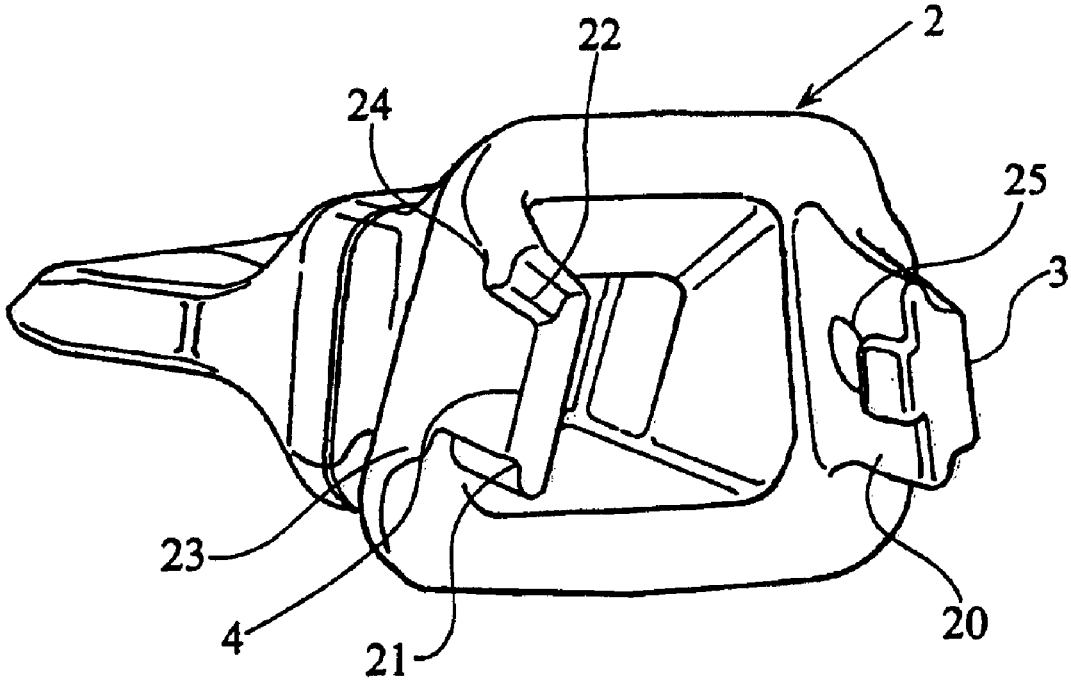
FIG. 9 is a rear perspective view of the same tooth.

The lugs 3 and 4 of the tooth are composed of stepped guides and curved regions. In FIG. 9 can be seen, for example for the lug 4, the stepped guides 21 and 22, and also the curved end regions 23 and 24.

The lugs are slightly inclined parallel to the lateral surfaces of the nose of the tooth holder, and during the mounting of the tooth are fitted into the lateral cavities thereof. The stepped guides, such as those indicated by the numbers 21 and 22, are a combination of flat surfaces. One of the lugs, which has been indicated in the drawings by the number 3, has a transverse aperture 25 for inspecting the introduction of the pin and for facilitating its disassembly by means of the introduction of a tool.

According to the present invention, the stepped guides are intended to guide the mounting of the tooth in the tooth holder and to stabilize the assembly. The abutment 20 provided at the end of one of the lugs is intended to retain the pin by its rearward part.

The curved regions, such as those indicated by the numbers 23 land 24, serve to reinforce the lug against vertical stresses on increasing the flat surface; and the section, distributing the vertical stresses better.

Figure 17:
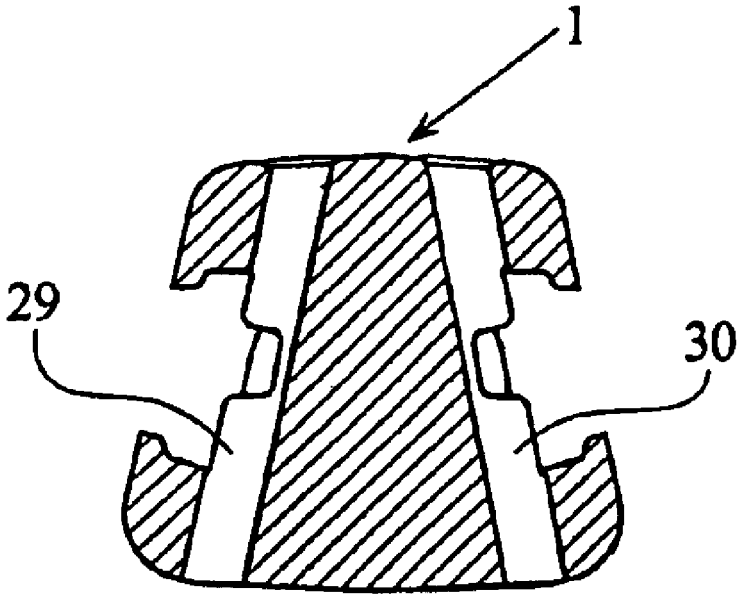
FIGS. 17 and 18 show cross sections through the planes indicated in FIG. 15.
Figure 18:
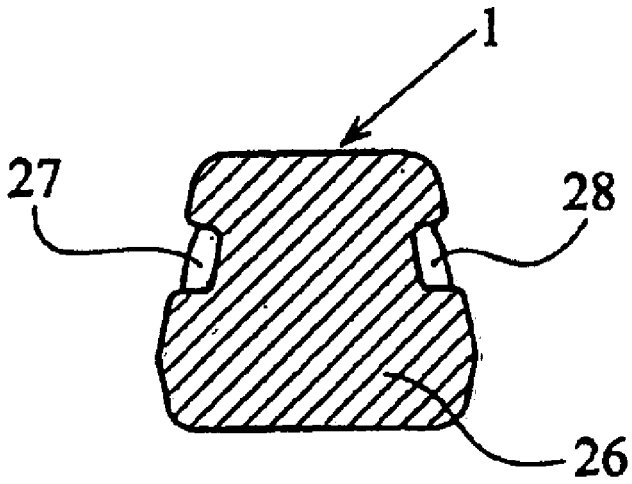

Moreover, with regard to the specific shape of the lugs, provision may be made for abutments to be arranged on both in the case of a double guide providing for the coupling of two pins, as in the version shown in FIGS. 17 and 18, in which the nose 26 of the tooth holder has two lateral guides 27 and 28 for respective pins housed in the respective pin seatings 29 and 30.

Figure 19:
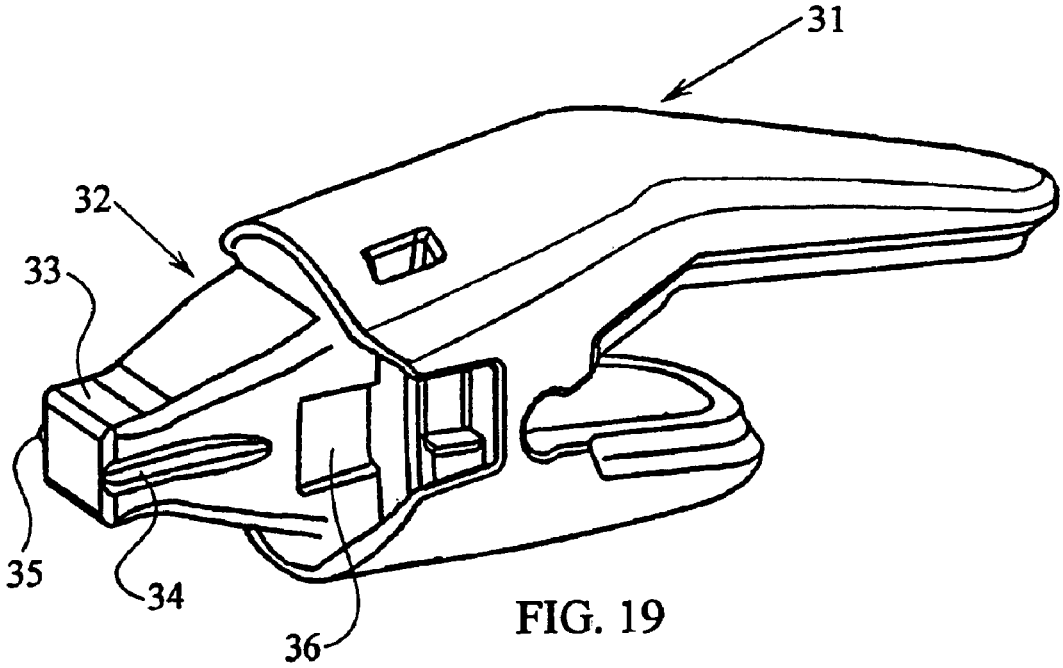
FIGS. 19 and 20 show respective perspective views of alternative embodiments of the tooth holder according to the present invention.

FIG. 19 shows an alternative embodiment of a tooth holder 31 with a coupling projection or nose 32, which has the end appendage 33 of substantially square or rectangular prismatic shape, having longitudinal ribs 34 and 35 as well as grooves 36 which are not of the through type, the remainder of the tooth holder corresponding essentially to the features of the invention as shown especially in FIG. 6.

Figure 20:
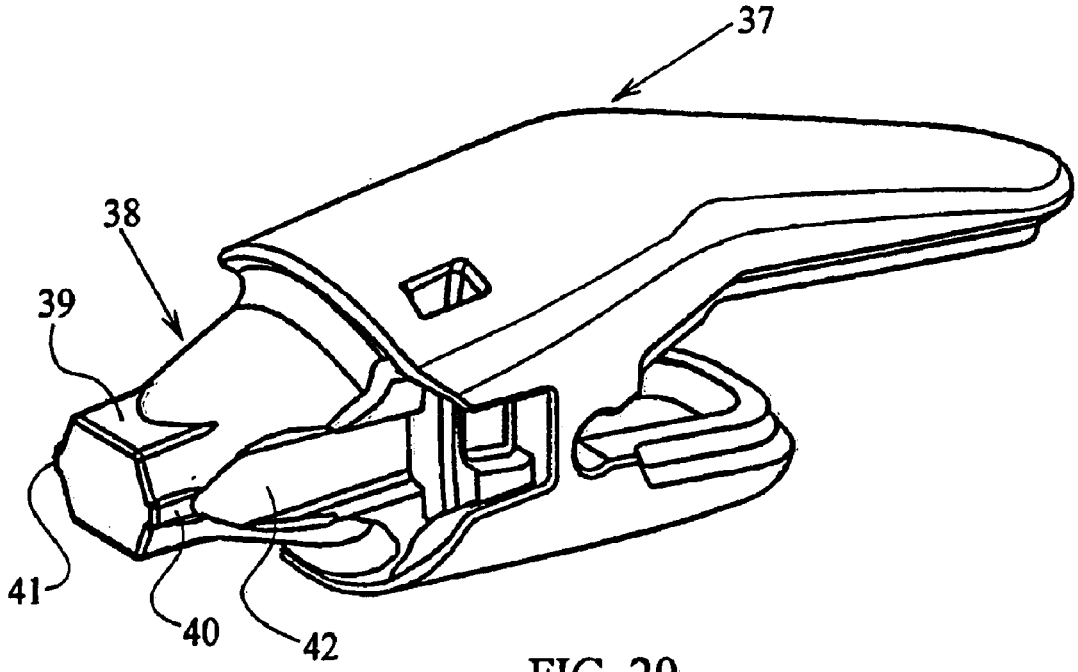

FIG. 20 shows a further alternative embodiment 37, in which the rear projection or nose 38 has an appendage 39 having a substantially hexagonal section with straight ribs 40 and 41 on the sides. One of the lateral grooves has also been shown, indicated by the number 42, the remainder of the tooth holder corresponding to the present invention according to the versions previously indicated.

Figure 21:
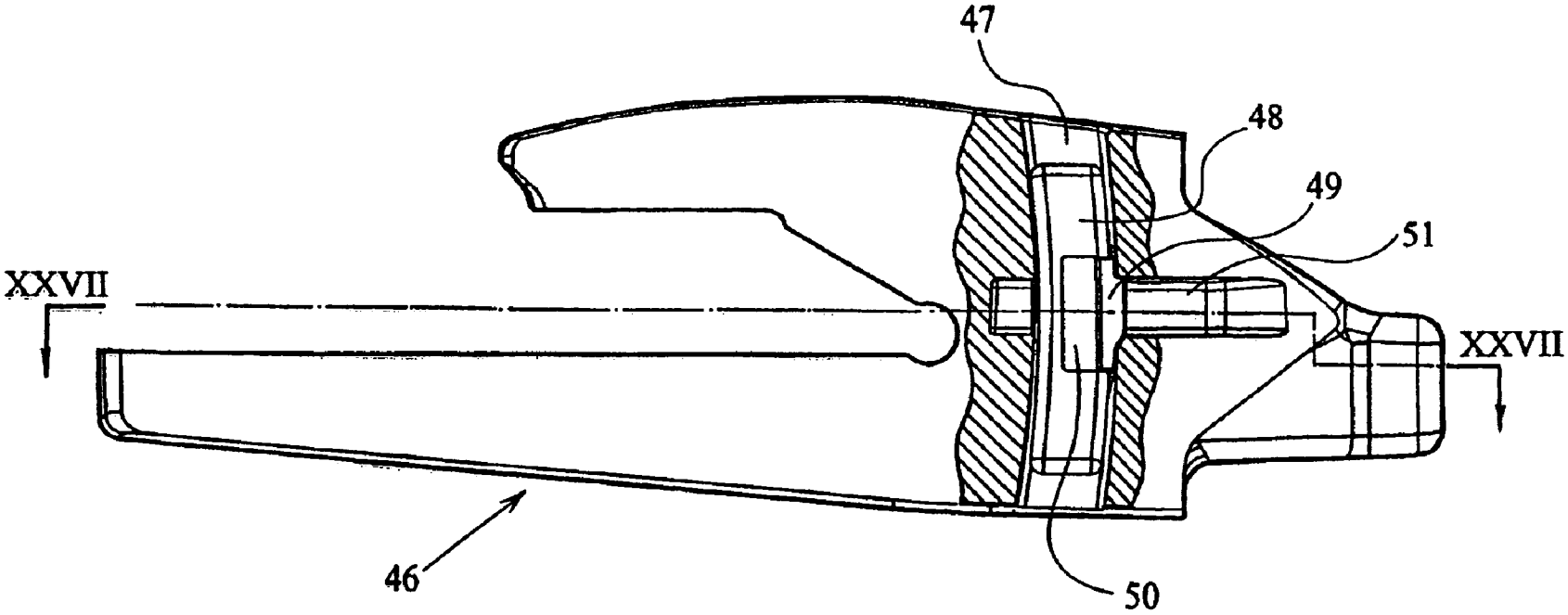
FIG. 21 shows a diagrammatic longitudinal section through a tooth holder according to the invention, showing a completely mounted pin.

FIG. 21 shows a tooth holder 46 having a pin seating generally arranged as explained previously, indicated by the number 47, and corresponding in this case to a curved version of arched shape in the interior of which is housed the pin 48 carrying a centring and retaining addition 49 supported by a resilient block 50 and the frontal expansion of which introduces the retaining means partially into the guide groove 51.

Figure 23:
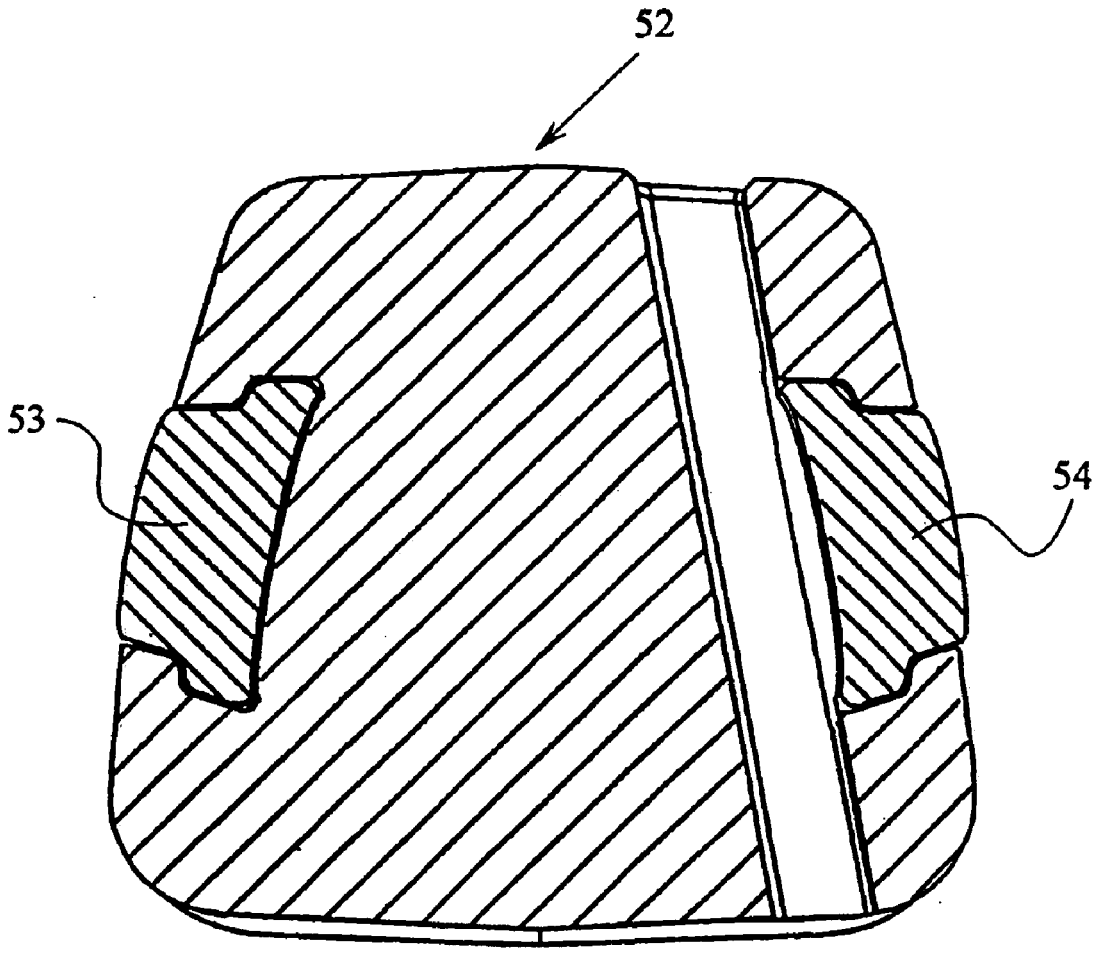
FIG. 23 shows a cross section through a tooth holder with lugs of the tooth having a transversely curved shape.

FIG. 23 shows a version in which the tooth holder body 2 has coupled to it the lugs 53 and 54 of the tooth, which have an arched cross section and which adapt to a matching shape of the receiving grooves of the tooth holder.

As shown in FIGS. 24, 25 and 26, the pin 48, which in the case illustrated has a generally arched shape, but which obviously could also be straight, has the centring and retaining member formed by the resilient block 50 and the metallic block 55, which has at the top and bottom respective additional guiding fins 56 and 57 narrower than the projecting metallic block 55, being housed in grooves of matching shape of the pin 48.

FIG. 27 shows a section through a horizontal plane of an assembly of tooth 58 and tooth holder 59. In said section can be seen the pin 60, which has incorporated in it the resilient block 61 and the metallic projection 62, the structures of which correspond to those indicated in FIGS. 24 to 26.

What is claimed is:

1. A coupling for a tooth of earth-moving machines, comprising projecting lugs on the tooth configured to couple with matching seatings of a tooth holder and a transverse seating for a pin, the lugs of the tooth longitudinally have stepped guides on upper and lower edges of the lugs and which continue in an area of attack in widened abutment regions to obtain greater reinforcement, combined with matching profiles of said stepped guides and widened regions in a body of the tooth holder and with an internal projecting abutment arranged in at least one of said lugs, configured to be guided in an internal part of a corresponding straight guide of the tooth holder, said abutment, after mounting of the tooth in the tooth holder, arranged to retain the pin, the pin disposed in a pin seating provided in a generally vertical arrangement in the body of the tooth holder; and wherein the lugs of the tooth are gently inclined transversely, the upper and lower edges of the lugs being in different vertical planes.

2. The coupling according to claim 1, wherein the widened abutment regions have a curved shape.

3. The coupling according to claim 1, wherein the widened abutment regions are in a shape of an inclined plane.

4. The coupling according to claim 1, wherein the widened abutment regions are in a shape of a straight step.

5. The coupling according to claim 1, wherein the lugs of the tooth have their upper edges arranged further towards an interior of the tooth than their lower edges.

6. The coupling according to claim 1, wherein the lugs of the tooth have transversely a flat or curved shape.

7. The coupling according to claim 1, wherein the straight guide of the tooth holder is formed on a nose of the tooth holder for the internal abutment of the lugs of the tooth, and extend for a length shorter than a total length of said nose of the tooth holder, in order to obtain greater mechanical strength.

8. The coupling according to claim 1, wherein the straight guide of the tooth holder is formed on a nose of the tooth holder for the internal abutment or abutments of the lugs of the tooth and extend as far as a rear end of said nose with its open end.

9. The coupling according to claim 1, comprising an arrangement of an inlet chamfer in an opening for introduction of the pin, in order to improve mounting and disassembly of the pin.

10. A coupling for a tooth of earth-moving machines, comprising projecting lugs on the tooth configured to couple with matching seatings of a tooth holder and a transverse seating for a pin, the lugs of the tooth longitudinally have stepped guides on upper and lower edges of the lugs and which continue in an area of attack in widened abutment regions to obtain greater reinforcement, combined with matching profiles of said stepped guides and widened regions in a body of the tooth holder and with an internal projecting abutment arranged in at least one of said lugs, configured to be guided in an internal part of a corresponding straight guide of the tooth holder, said abutment, after mounting of the tooth in the tooth holder, arranged to retain the pin, the pin disposed in a pin seating provided in a generally vertical arrangement in the body of the tooth holder; and wherein at least one of the lugs of the tooth, which extends laterally, has a transverse aperture for inspecting the coupling of the pin and for assisting the disassembly of the pin.

11. The coupling according to claim 10, wherein the widened abutment regions have a curved shape.

12. The coupling according to claim 10, wherein the widened abutment regions are in a shape of an inclined plane.

13. The coupling according to claim 10, wherein the widened regions are in a shape of a straight step.

14. The coupling according to claim 10, wherein the lugs of the tooth are gently inclined transversely, the upper and lower edges of the lugs being in different vertical planes.

15. The coupling according to claim 10, wherein the lugs of the tooth have their upper edges arranged further towards an interior of the tooth than their lower edges.

16. The coupling according to claim 10, wherein the lugs of the tooth have transversely a flat or curved shape.

17. The coupling according to claim 10, wherein the straight guide of the tooth holder is formed on a nose of the tooth holder for the internal abutment of the lugs of the tooth, and extend for a length shorter than a total length of said nose of the tooth holder, in order to obtain greater mechanical strength.

18. The coupling according to claim 10, wherein the straight guide of the tooth holder is formed on a nose of the tooth holder for the internal abutment or abutments of the lugs of the tooth and extend as far as a rear end of said nose with its open end.

19. The coupling according to claim 10, comprising an arrangement of an inlet chamfer in an opening for introduction of the pin, in order to improve mounting and disassembly of the pin.

20. A tooth adapted to be connected to a tooth holder of an earth moving machine wherein the tooth holder has a protruding portion, said tooth having a cavity for receiving the protruding portion of the tooth holder, and protruding ears on each side of the cavity adapted to be received in corresponding housings of the tooth holder, wherein said ears are inclined and the distance between the upper parts of the ears is less than the distance between the lower parts of the ears.

21. A tooth according to claim 20, wherein said cavity has a mouth, wherein the mouth of said cavity of the tooth has a substantially trapezoidal cross section shape with the longer of the two parallel sides of the trapezoid at the bottom of said mouth.

22. A tooth according to claim 21, wherein said protruding ears are substantially parallel with the sides of the trapezoidal mouth of the cavity.

23. A tooth according to claim 20, said cavity having the inner shape and size corresponding to the outer shape and size of the protruding portion of the tooth holder, whereby said tooth fits tightly around the protruding portion.

24. A tooth according to claim 20, whereby said protruding ears have respective inner parts connecting the ear to the remainder of the tooth, each of said inner parts being provided with a larger cross section area than the rest of the ear.

25. A tooth according to claim 24, wherein the height of the inner part of the ear is larger than the height of the rest of the ear.

26. A tooth according to claim 24, wherein the width of the inner part of the ear is larger than the width of the rest of the ear.

27. A tooth according to claim 20, wherein each of the ears is provided with stepped guides at least at one of its upper and lower regions.

28. A tooth according to claim 20, whereby said tooth is adapted to be locked on the tooth holder by a retaining pin, wherein at least one of said ears is provided with an inwardly protruding stop member for holding the tooth in the desired position on the tooth holder when being locked by the retaining pin.

29. A tooth holder adapted to be connected to an earth moving machine, said tooth holder having a protruding portion adapted to be received in a cavity of a tooth, and a housing located on each side of the protruding portion for receiving protruding ears of the tooth, wherein a lateral inner surface of each of the housings, which is adapted to be facing the inner surface of the tooth ear, is inclined whereby the transverse distance between the upper part of the said housings is less than the transverse distance between the lower parts of said housings.

30. A tooth holder according to claim 29, said tooth holder including a body, and an inner part is provided to connect the protruding portion to the tooth holder body, said inner part having a substantially trapezoidal cross section shape with the longer of the two parallel sides at the bottom.

31. A tooth holder according to claim 30, wherein the inclination of said lateral inner surface of each of the housings is substantially the same as the inclination of the sides of said trapezoidal part of the protruding portion.

32. A tooth holder according to claim 29, wherein an outer part of the protruding portion, which forms the free end of the protruding portion, and has a substantially trapezoidal cross section shape with the longer of the two parallel sides at the top.

33. A tooth holder according to claim 29, wherein the tooth holder comprises at least one hole extending from an upper surface of the tooth holder at least to said housing, for receiving a retention pin.

34. A tooth holder according to claim 33, said tooth holder having a body, wherein the hole for the retention pin is located in said body of the tooth holder at a predetermined distance from the protruding portion of the tooth holder.

35. A tooth holder according to claim 33, wherein the hole for the retention pin extends substantially parallel to said lateral inner surface of said housing.

36. A tooth holder according to claim 33, wherein the tooth holder comprises a lateral groove extending in the connection direction of the tooth and the tooth holder for receiving a stop member on the ear of the tooth.

37. A tooth holder according to claim 36, wherein said hole for the retention pin intersects said lateral groove.

38. A tooth holder according to claim 29, wherein each of the housings is provided with stepped guides at least at one of its upper and lower regions.

39. A tooth holder according to claim 29, wherein each of said housings has a rear part forming a mouth, adapted to received ears of a tooth, said mouth being wider than the inner parts of the housing to strengthen the support zone of the tooth holder.

40. A tooth system for a bucket-of an earth moving machine comprising a tooth according to claim 20 and a corresponding tooth holder adapted to be connected to the bucket of the earth moving machine, said tooth holder having a protruding portion adapted to be received in the cavity of the tooth, and a housing located on each side of the protruding portion for receiving the protruding ears of the tooth, wherein a lateral inner surface of each of the housings, which is adapted to be facing the inner surface of the tooth ear, is inclined whereby the transverse distance between the upper part of the said housings is less than the transverse distance between the lower parts of said housings.

* * * * *